US005951408A

United States Patent [19]

Inman

[11] Patent Number: 5,951,408

[45] Date of Patent: Sep. 14, 1999

[54] GOLF SWING TRAINING SYSTEM

[76] Inventor: David R. Inman, 1847 E. Apache Blvd., #18, Temple, Ariz. 85281

[21] Appl. No.: 09/243,408

[22] Filed: Feb. 1, 1999

[51] Int. Cl.[6] ..... A63B 69/36

[52] U.S. Cl. ..... 473/212; 473/276; 473/409; 273/DIG. 30

[58] Field of Search ..... 473/212, 276, 473/409; 273/DIG. 30

[56] References Cited

U.S. PATENT DOCUMENTS

| | | | |
|---|---|---|---|
| 475,432 | 5/1892 | Blates | 473/276 X |
| 1,699,219 | 1/1929 | Bemish et al. | 473/212 |
| 2,808,267 | 10/1957 | Heaton | 473/212 |
| 4,058,852 | 11/1977 | Aragona | 473/212 X |
| 4,892,317 | 1/1990 | Coriter | 473/212 |
| 5,114,142 | 5/1992 | Gillespie et al. | 273/26 C |
| 5,188,365 | 2/1993 | Picard | 273/189 R |
| 5,295,690 | 3/1994 | Johnson | 273/187.2 |
| 5,397,122 | 3/1995 | Herridge, II | 273/189 R |
| 5,665,015 | 9/1997 | Clark, III | 473/409 |
| 5,718,640 | 2/1998 | Noblin | 473/212 |

*Primary Examiner*—George J. Marlo
*Attorney, Agent, or Firm*—Joseph N. Breaux

[57] ABSTRACT

A golf swing training system that includes an arm securing mechanism for assisting a golfer to maintain the upper arm and elbow tucked against the chest during golf swing practice. The arm securing mechanism includes hook and pile fastener areas that allow for easy attachment of the upper arm and/or elbow areas of the user's arm to a natural location on the user's chest. The golf swing training system includes a chest strap assembly and an arm strap assembly that are securable together to restrict movement of the user's arm during practice golf swings. IN another aspect of the invention a golf swing training method is provided that includes the steps of 1) providing a golf swing training system as previously described, 2) securing the chest strap assembly in place around the user's chest, 3) securing the arm strap around the upper arm of the user orienting the arm strap side area toward the chest of the user, 4) contacting the arm strap side area with the chest strap side area to secure the user's upper arm in a fixed relationship with the user's chest, and 5) swinging a golf club.

2 Claims, 1 Drawing Sheet

GOLF SWING TRAINING SYSTEM

TECHNICAL FIELD

The present invention relates to athletic training systems and more particularly to a golf swing training system and a golf swing training method utilizing the golf swing training system; the golf swing training system including a chest strap assembly and an arm strap assembly that are securable together to restrict movement of the user's arm during practice golf swings; the chest strap assembly including two shoulder straps secured to a chest strap that is sized to fit around the chest of the user and that is securable at a user selected circumference about the user's chest with hook and pile fasteners, the chest strap including an exterior facing chest strap side area covered with hook and pile fastener material; the arm strap assembly including an arm strap that is sized to fit around the arm of a user that is securable at a user selected circumference around the upper arm of the user with hook and pile fasteners, the arm strap including an exteriorly facing arm strap side area covered with hook and pile fastener material that is companionate with the hook and pile fastener material of the chest strap side area; the golf swing training method including the steps of 1) providing a golf swing training system as previously described, 2) securing the chest strap assembly in place around the user's chest, 3) securing the arm strap around the upper arm of the user orienting the arm strap side area toward the chest of the user, 4) contacting the arm strap side area with the chest strap side area to secure the user's upper arm in a fixed relationship with the user's chest, and 5) swinging a golf club.

BACKGROUND ART

Many golfers believe a proper golf swing is one of the most difficult athletic movements to properly execute. Because a correct golf swing is believed to require the golfer to keep his/her elbow tucked against the chest, it would be a benefit to have a golf swing training system that included a mechanism for allowing a golfer to maintain the upper arm and elbow tucked against the chest during golf swing practice to train the body to perform as desired when the mechanism is removed. Because proper positioning of the elbow and upper arm with respect to the chest must be maintained at a natural position in order to achieve a proper golf swing, it would be a further benefit to have a golf swing training system that included a mechanism that allowed for easy attachment of the upper arm and/or elbow areas of the user's arm to a natural location on the user's chest.

GENERAL SUMMARY DISCUSSION OF INVENTION

It is thus an object of the invention to provide a golf swing training system that includes a mechanism for allowing a golfer to maintain the upper arm and elbow tucked against the chest during golf swing practice.

It is a further object of the invention to provide a golf swing training system that includes a mechanism that allows for easy attachment of the upper arm and/or elbow areas of the user's arm to a natural location on the user's chest.

It is a still further object of the invention to provide a golf swing training system that includes a chest strap assembly and an arm strap assembly that are securable together to restrict movement of the user's arm during practice golf swings; the chest strap assembly including two shoulder straps secured to a chest strap that is sized to fit around the chest of the user and that is securable at a user selected circumference about the user's chest with hook and pile fasteners, the chest strap including an exterior facing chest strap side area covered with hook and pile fastener material; the arm strap assembly including an arm strap that is sized to fit around the arm of a user that is securable at a user selected circumference around the upper arm of the user with hook and pile fasteners, the arm strap including an exteriorly facing arm strap side area covered with hook and pile fastener material that is companionate with the hook and pile fastener material of the chest strap side area.

It is a still further object of the invention to provide a golf swing training method that includes the steps of 1) providing a golf swing training system as previously described, 2) securing the chest strap assembly in place around the user's chest, 3) securing the arm strap around the upper arm of the user orienting the arm strap side area toward the chest of the user, 4) contacting the arm strap side area with the chest strap side area to secure the user's upper arm in a fixed relationship with the user's chest, and 5) swinging a golf club.

It is a still further object of the invention to provide a golf swing training system and method that accomplishes all or some of the above objects in combination.

Accordingly, in a first aspect of the invention a golf swing training system is provided. The golf swing training system includes a chest strap assembly and an arm strap assembly that are securable together to restrict movement of the user's arm during practice golf swings; the chest strap assembly including two shoulder straps secured to a chest strap that is sized to fit around the chest of the user and that is securable at a user selected circumference about the user's chest with hook and pile fasteners, the chest strap including an exterior facing chest strap side area covered with hook and pile fastener material; the arm strap assembly including an arm strap that is sized to fit around the arm of a user that is securable at a user selected circumference around the upper arm of the user with hook and pile fasteners, the arm strap including an exteriorly facing arm strap side area covered with hook and pile fastener material that is companionate with the hook and pile fastener material of the chest strap side area.

In a second aspect of the invention a golf swing training method is provided that includes the steps of 1) providing a golf swing training system as previously described, 2) securing the chest strap assembly in place around the user's chest, 3) securing the arm strap around the upper arm of the user orienting the arm strap side area toward the chest of the user, 4) contacting the arm strap side area with the chest strap side area to secure the user's upper arm in a fixed relationship with the user's chest, and 5) swinging a golf club.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
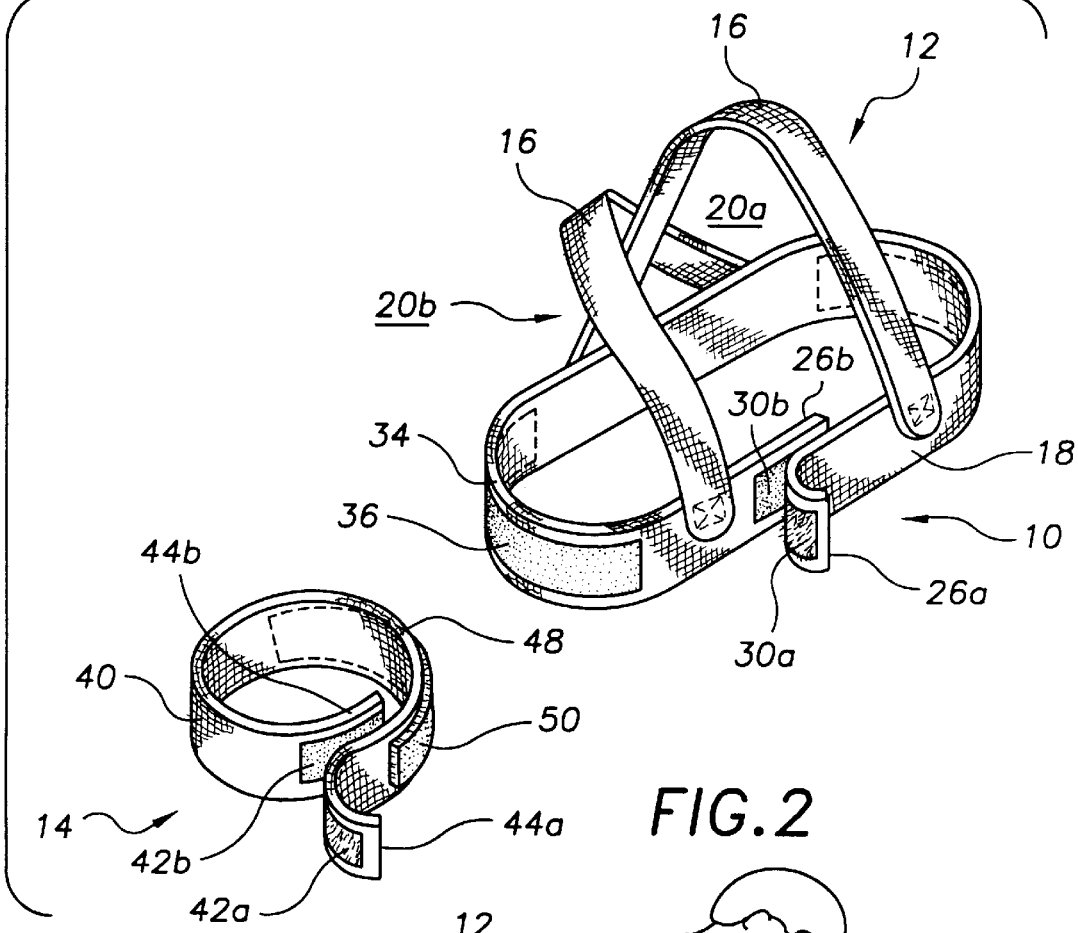
FIG. 1 is a perspective view of the golf swing training system of the present invention showing an exemplary chest strap assembly and an exemplary arm strap assembly; the chest strap assembly including two shoulder straps secured to a nylon webbing chest strap that is sized to fit around the chest of the user that is securable at a user selected circumference with hook and pile fasteners and that includes an exterior facing chest strap side area covered with hook and pile fastener material; the arm strap assembly including a nylon webbing arm strap that is sized to fit around the arm of a user that is securable at a user selected circumference with hook and pile fastener and that includes an exteriorly facing arm strap side area covered with hook and pile fastener material that is companionate with the hook and pile fastener material of the chest strap side area.

FIG. 1 shows an exemplary embodiment of the golf swing training system of the present invention generally designated 10. Golf swing training system 10 includes a chest strap assembly, generally designated 12, and an arm strap assembly, generally designated 14. Chest strap assembly 12 includes two one inch wide nylon webbing shoulder straps 16 that are stitched at the ends thereof to a four inch wide nylon webbing chest strap 18 to form left and right shoulder insertion openings 20*a*,20*b*. In this embodiment, chest strap 18 is fifty inches long although chest strap need only be of a length sized to fit around the chest of the user. The facing surfaces of ends 26*a*,26*b* of chest strap 18 are provided with companionate sections of hook and pile fastener material 30*a*,30*b* to allow a user to secure chest strap 18 at the desired circumference around the chest/upper torso. An exterior facing chest strap side area 34 on the right side of chest strap 18 and below right shoulder insertion opening 20*b* is covered with hook and pile fastener material 36.

Arm strap assembly 14 includes an arm strap 40 formed from a twenty-two inch length of four inch wide nylon webbing having companionate hook and pile fastener sections 42*a*,42*b* at the ends 44*a*,44*b* thereof to allow the user to secure arm strap 40 at a user selected circumference around the upper arm adjacent to the elbow. An exteriorly facing arm strap side area 48 is covered with hook and pile fastener material 50 that is companionate with the hook and pile fastener material 36 of chest strap side area 34.

Figure 2:
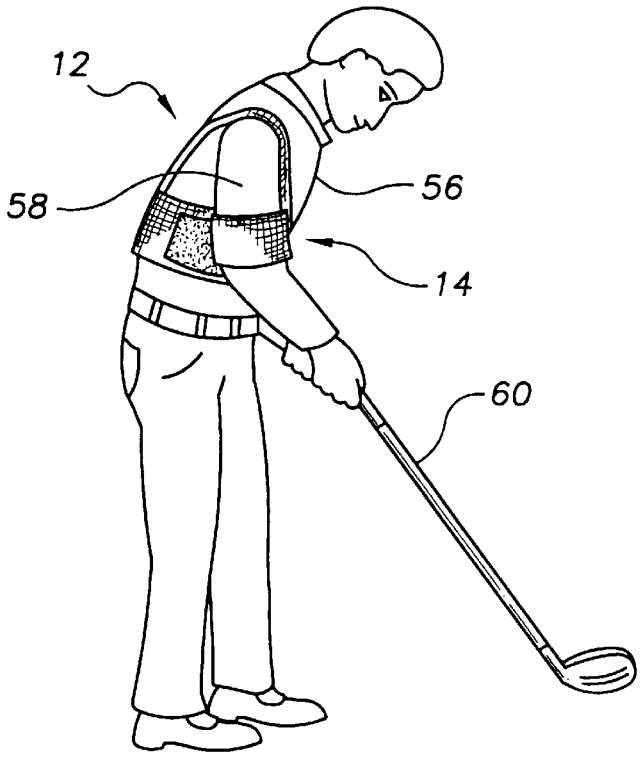
FIG. 2 is a side plan view showing the golf swing training system of FIG. 1 in use with the chest strap assembly secured around the chest of the user, the arm strap assembly secured around the upper arm of the user, and the arm strap side area attached to the chest strap side area with the companionate hook and pile fastener material to limit movement of the user's arm during the gold swing.

With general reference to FIGS. 1 and 2, golf swing training system 10 is used in an exemplary golf swing training method by 1) providing a golf swing training system 10; 2) securing chest strap assembly 12 in place around the user's chest/upper torso 56; 3) securing arm strap assembly 14 around the upper arm 58 of the user with arm strap side area 50 oriented toward the chest/upper torso 56 of the user, 4) contacting arm strap side area 48 with the chest strap side area 34 to secure the user's upper arm 58 in a fixed relationship with the user's chest 56, and 5) repeatedly swinging a golf club 60.

It can be seen from the preceding description that in a first aspect of the invention a golf swing training system has been provided that includes a mechanism for allowing a golfer to maintain the upper arm and elbow tucked against the chest during golf swing practice; that includes a mechanism that allows for easy attachment of the upper arm and/or elbow areas of the user's arm to a natural location on the user's chest; that includes a chest strap assembly and an arm strap assembly that are securable together to restrict movement of the user's arm during practice golf swings; the chest strap assembly including two shoulder straps secured to a chest strap that is sized to fit around the chest of the user and that is securable at a user selected circumference about the user's chest with hook and pile fasteners, the chest strap including an exterior facing chest strap side area covered with hook and pile fastener material; the arm strap assembly including an arm strap that is sized to fit around the arm of a user that is securable at a user selected circumference around the upper arm of the user with hook and pile fasteners, the arm strap including an exteriorly facing arm strap side area covered with hook and pile fastener material that is companionate with the hook and pile fastener material of the chest strap side area; and in a second aspect of the invention a golf swing training method has been provided that includes the steps of 1) providing a golf swing training system as previously described, 2) securing the chest strap assembly in place around the user's chest, 3) securing the arm strap around the upper arm of the user orienting the arm strap side area toward the chest of the user, 4) contacting the arm strap side area with the chest strap side area to secure the user's upper arm in a fixed relationship with the user's chest, and 5) swinging a golf club.

It is noted that the embodiments of the golf swing training system and golf swing training method described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A golf swing training system comprising:

a chest strap assembly; and an arm strap assembly;

said chest strap assembly including two shoulder straps secured to a chest strap that is sized to fit around the chest of the user and that is securable at a user selected circumference about the user's chest with hook and pile fasteners, said chest strap including an exterior facing chest strap side area covered with hook and pile fastener material;

said arm strap assembly including an arm strap that is sized to fit around the arm of a user that is securable at a user selected circumference around the upper arm of the user with hook and pile fasteners, said arm strap including an exteriorly facing arm strap side area covered with hook and pile fastener material that is companionate with said hook and pile fastener material of said chest strap side area.

2. A golf swing training method comprising the steps of:

a) providing a golf swing training system comprising a chest strap assembly and an arm strap assembly; said chest strap assembly including two shoulder straps secured to a chest strap that is sized to fit around the chest of the user and that is securable at a user selected circumference about the user's chest with hook and pile fasteners, said chest strap including an exterior facing chest strap side area covered with hook and pile fastener material; said arm strap assembly including an arm strap that is sized to fit around the arm of a user that is securable at a user selected circumference around the upper arm of the user with hook and pile fasteners, said arm strap including an exteriorly facing arm strap side area covered with hook and pile fastener material that is companionate with said hook and pile fastener material of said chest strap side area;

b) securing said chest strap assembly in place around the user's chest;

c) securing said arm strap around the upper arm of the user orienting said arm strap side area toward the chest of the user;

d) contacting said arm strap side area with said chest strap side area to secure the user's upper arm in a fixed relationship with the user's chest; and e) repeatedly swinging a golf club.

* * * * *